US008141724B2

(12) United States Patent
Northam et al.

(10) Patent No.: US 8,141,724 B2
(45) Date of Patent: Mar. 27, 2012

(54) DOUBLE SIDED BIN HOLDER ASSEMBLY

(75) Inventors: Paul E. Northam, Corinth, TX (US); Eric C. Yocum, Dover, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 361 days.

(21) Appl. No.: 12/467,584

(22) Filed: May 18, 2009

(65) Prior Publication Data

US 2010/0288716 A1 Nov. 18, 2010

(51) Int. Cl.
*A47B 57/00* (2006.01)

(52) U.S. Cl. ..... 211/191

(58) Field of Classification Search ..... 211/191, 211/94.01, 70.6, 126.7, 153, 122, 87.01, 211/128.1
See application file for complete search history.

(56) References Cited

U.S. PATENT DOCUMENTS 3,486,634 A * 12/1969 Frater ..... 211/128.1
3,698,565 A * 10/1972 Weber ..... 211/87.01
3,780,852 A * 12/1973 Weiss et al. ..... 211/122
4,015,713 A * 4/1977 Clipson et al. ..... 206/509
4,817,900 A * 4/1989 Whittington et al. .... 248/223.41
4,828,121 A * 5/1989 Willcocks, Jr. ..... 211/94.01
5,390,803 A 2/1995 McAllister
5,775,521 A * 7/1998 Tisbo ..... 211/94.01
5,884,567 A 3/1999 Bartz, Jr.
6,253,687 B1 7/2001 McAllister
7,325,697 B2 * 2/2008 Lim et al. ..... 211/133.1
7,527,156 B2 * 5/2009 Wisnoski et al. ..... 211/70.6
7,686,172 B2 * 3/2010 Wisnoski et al. ..... 211/94.01
7,959,017 B2 * 6/2011 Gerstner et al. ..... 211/84
2006/0180561 A1 * 8/2006 Wisnoski et al. ..... 211/94.01
2006/0196842 A1 * 9/2006 Taylor et al. ..... 211/186
2007/0012636 A1 * 1/2007 Wisnoski et al. ..... 211/70.6
2008/0053931 A1 * 3/2008 Newbould et al. ..... 211/88.01
2008/0197091 A1 * 8/2008 Lim et al. ..... 211/126.1
2008/0296245 A1 * 12/2008 Punzel et al. ..... 211/153
2008/0302744 A1 * 12/2008 Rosenberg ..... 211/94.01
2009/0178989 A1 * 7/2009 Accuardi ..... 211/126.7

* cited by examiner

*Primary Examiner* — Sarah Purol
(74) *Attorney, Agent, or Firm* — Connolly Bove Lodge & Hutz LLP

(57) ABSTRACT

A double sided bin holder assembly comprises four upstanding posts and at least one horizontal H-shaped frame including two spaced apart parallel side bars and at least one middle bar connected between the side bars. A collar is positioned at each end of the side bars for adjustable connection to the upstanding posts. At least one upwardly extending flange on the middle bar functions to receive and support a plurality of bins with undercut portions thereon that fit over the upwardly extending flange on the middle bar on the H-shaped frame.

15 Claims, 4 Drawing Sheets

DOUBLE SIDED BIN HOLDER ASSEMBLY

BACKGROUND OF THE INVENTION

The present invention relates to an arrangement for holding bins, and more particularly to a double sided bin holder assembly for receiving and supporting a plurality of individually removable bins.

A wide variety of shelving systems are well known in the art such as those systems illustrated and described in U.S. Pat. Nos. 5,390,803, 5,884,567 and 6,253,687, incorporated herein by reference for all useful purposes. Traditionally these systems comprise a group of upstanding posts that adjustably support horizontally oriented wiring shelving of one type of another. In most instances the wiring shelving has a flat horizontal support surface while in other instances the shelving is specifically designed to accommodate and support particularly shaped products, such as wine bottles and the like. Other forms of adjustable horizontal support constructions are needed to hold and support other things such as individual bins, and the present invention addresses those needs.

SUMMARY OF THE INVENTION

Accordingly, among the objections of the present invention is a double sided bin holder assembly which is simple in construction yet highly reliable in supporting a plurality of individual bins in a safe and efficient manner.

Another object of the present invention is a double sided bin holder assembly where the bins are individually removable from the assembly.

Still another object of the present invention is a double sided bin holder assembly where the bins are adjustably mounted on the assembly and capable of sliding from side-to-side.

Still another object of the present invention is a double sided bin holder assembly where the bins are adjustable in elevation and position relative to the assembly.

In accordance with the present invention, a double sided bin holder assembly comprises four upstanding posts including two spaced apart front posts and two spaced apart rear posts. Also included in the assembly is a horizontal H-shaped frame including two spaced apart parallel side bars having opposite ends and extending front-to-back on the assembly as well as at least one middle bar connected between the side bars and extending side-to-side on the assembly. A collar is positioned on each end of the side bars, and each collar is constructed and arranged for adjustable connection to the upstanding posts. At least one upwardly extending flange is positioned on the middle bar of the H-shaped frame, and the flange functions to receive and support a plurality of bins with undercut portions thereon that fit over the upwardly extending flange.

The double sided bin holder assembly is particularly utilized in combination with a plurality of bins each having a rear wall with an outer undercut portion adjacent thereto, and the at least one upwardly extending flange on the middle bar of the H-shaped frame is releasably received within the undercut portions on the outside of the bins with the rear walls thereof resting against the flange Preferably, a pair of spaced apart upwardly extending flanges are positioned on the middle bar of the H-shaped frame, and each flange functions to receive and support a plurality of bins each with an undercut portion thereon that fits over the flanges.

Preferably the pair of upwardly extending flanges are equally spaced apart from one another and include a front flange and a rear flange. It is also preferred that the front flange includes a lower portion that extends downwardly and slightly forward at an angle of about 5 degrees, and a lower portion of the rear flange extends downwardly and slightly rearward at an angle of about 5 degrees. As a result of these slight inclinations of the flanges, the bins at the front and back of the assembly tilt slightly upward but when loaded the bins flatten out and the bottom walls are generally horizontally oriented.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 2:
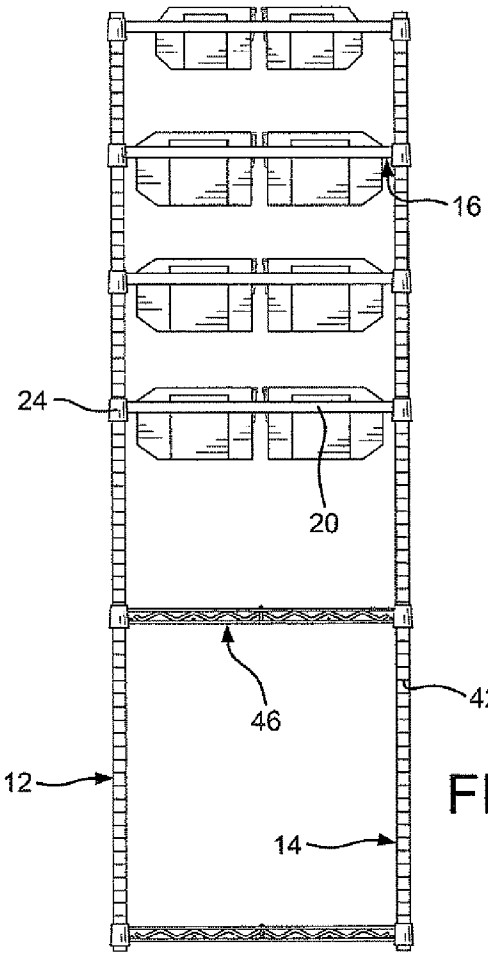
FIG. 2 is a right side elevational view of the double sided bin holder assembly shown in FIG. 1.
Figure 1:
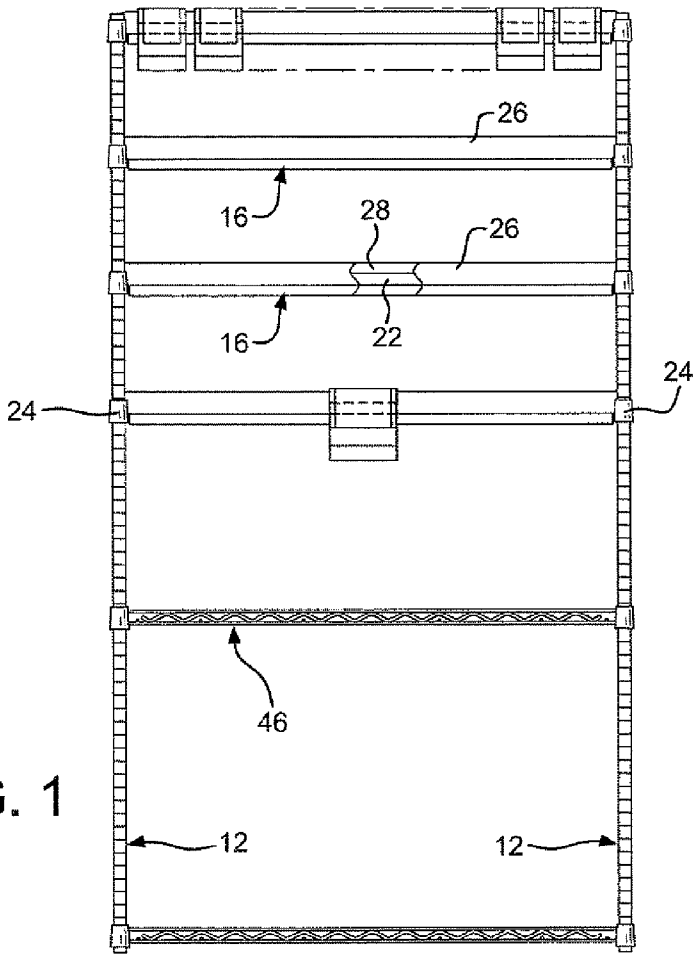
FIG. 1 is a front elevational view of a double sided bin holder assembly, according to the present invention.

Referring in more particularity to the drawings, FIGS. 1 and 2 illustrate a double sided bin holder assembly 10 comprising four upstanding posts including two spaced part front posts 12 and two spaced apart rear posts 14. Holder assembly 10 further comprises at least one horizontal H-shaped frame 16 that includes two spaced apart left and right side bars, 18, 20, respectively, parallel to one another with each side bar extending front-to-back on holder assembly 10. Additionally, at least one middle bar 22 is connected between the side bars 18, 20 and the middle bar extends side-to-side on the holder assembly. A collar 24 is connected on each end of the side bars 18, 20, and these collars are arranged for adjustable connection to the upstanding posts 12, 14, as explained more fully below. A pair of spaced apart upwardly extending flanges comprising front flange 26 and rear flange 28 are connected on the middle bar 22 of H-shaped frame 16, and these flanges function to receive and support bins with undercut portions thereon, as explained more fully below.

Figure 3:
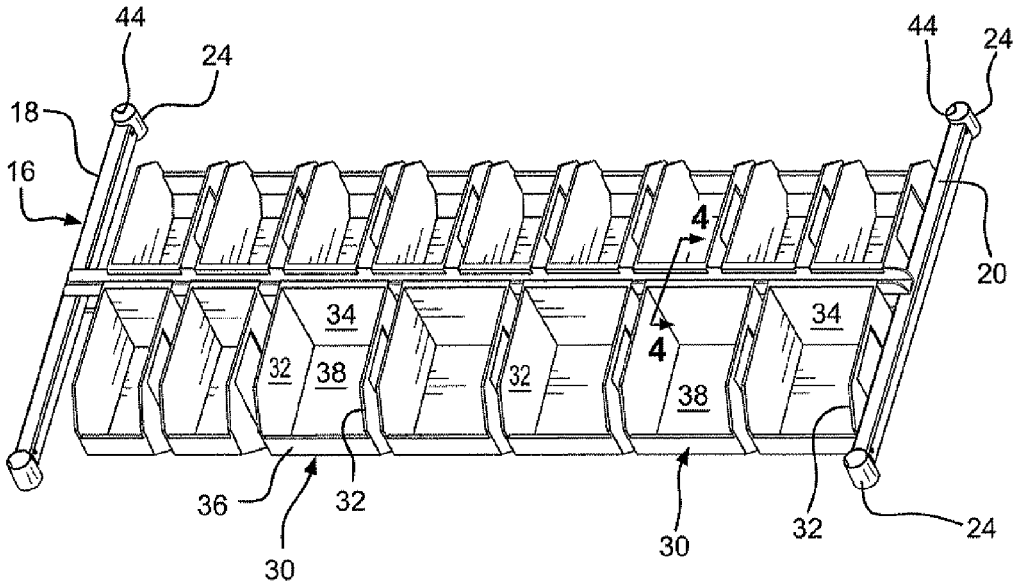
FIG. 3 is a perspective view of an H-shaped frame of the double sided bin holder assembly of FIGS. 1 and 2, with front and rear bins removably attached to the frame, according to the present invention.
Figure 4:
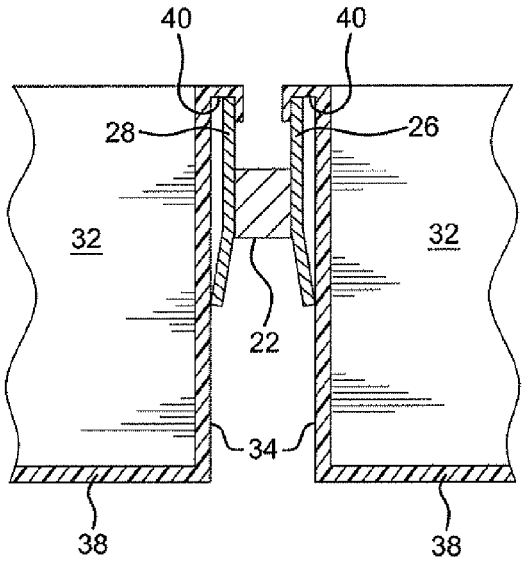
FIG. 4 is a sectional view taken along line 4-4 of FIG. 3.
Figure 5:
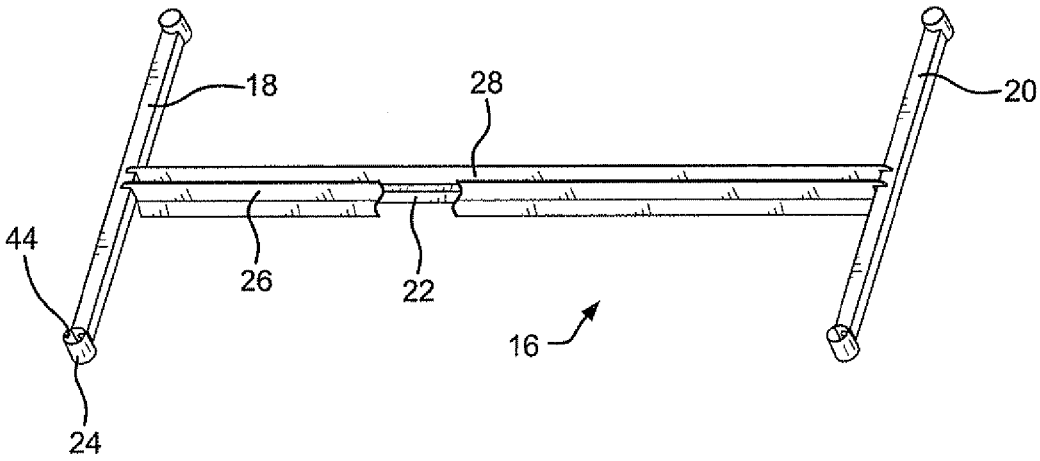
FIG. 5 is a perspective view of the H-shaped frame of the double sided bin holder assembly, according to the present invention.
Figure 6:
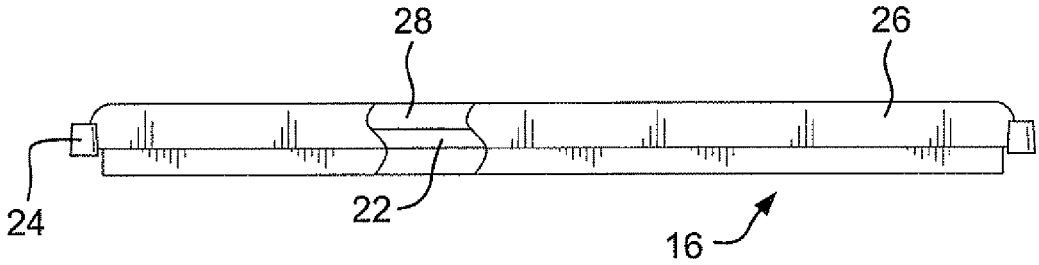
FIG. 6 is a front elevational view of the H-shaped frame shown in FIG. 5.
Figure 7:
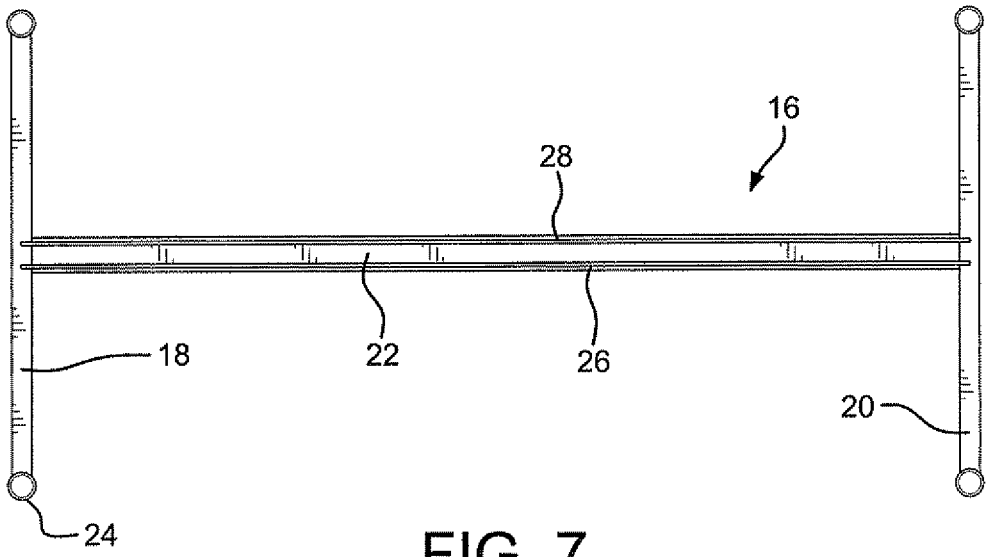
FIG. 7 is a top plan view of the H-shaped frame shown in FIG. 5.
Figure 8:
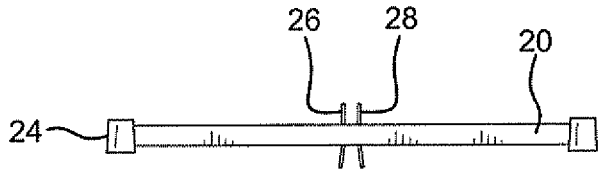
FIG. 8 is a right side elevational view of the H-shaped frame shown in FIG. 5.

Referring particularly to FIG. 3, the bins 30 of the present invention include opposed side walls 32, rear wall 34, front wall 36 and bottom wall 38. As shown best in FIG. 4, each bin 30 further includes an outer undercut portion 40 adjacent the rear wall 34 that fits over the front or rear upwardly extending flanges 26, 28 on the H-shaped frame. These undercut portions 40 accommodate the front/rear flanges when the bins 30 are supportingly connected to the double sided bin holder assembly 10. When so positioned the rear wall 34 of each bin 30 rests against one of the flanges 26, 28. Moreover, the width of the bins may vary, as shown in FIG. 3, and the front-to-back length of the bins may vary (not shown).

The adjustable connection between the posts 12, 14 and the H-shaped frame 16 is well known in the art and in this respect attention is directed to U.S. Pat. No. 5,390,803, for example. Specifically, the posts 12, 14 include a plurality of equally spaced annular grooves 42 and a two piece sleeve (not shown) is releasably secured to the posts at the desired elevation of the H-shaped frame 16. The two piece sleeve has a cylindrical interior with a diameter substantially equal to the diameter of the posts. An annular projection on the interior of the two piece sleeve fits within the desired groove 42 on the posts to thereby secure the two piece sleeve to the post at that elevation. The sleeve has an outer frusto conical surface, and the interior of each corner collar 24 also has a frusto conical shape 44 which fits over the sleeve to thereby releasably attach the H-shaped frame 16 to the posts 12, 14.

Details of the H-shaped frame 16 are shown in FIGS. 5-8 of the drawings. As shown best in FIGS. 4 and 8 the upwardly extending flanges 26, 28 are equally spaced apart from one another at the upper ends thereof and preferably the front flange 26 has a lower portion that extends downwardly and slightly forward at an angle of about 5 degrees. The rear flange 28 has a lower portion that extends downwardly and slightly rearward at an angle of about 5 degrees. As a result of these slight inclinations of the flanges 26, 28, and the slight resiliency of the material from which they are made, the unfilled bins 30 at the front and back of the assembly 10 tilt slightly upwardly. However, when the bins are filled with items to be stored therein they tend to flatten out and the bottom walls are horizontally oriented as shown in the drawings.

Overall the individual bins 30 are easily placed on and removed from the holder assembly 10 via the connection between the rear undercut portions 40 of the bins and the upwardly extending front and rear flanges 26, 28 on the H-shaped frame 16. Additionally, this connection enables the bins to slide side-to-side except when the H-shaped frame is fully loaded with bins as illustrated in FIG. 3.

Also, as shown in FIGS. 1 and 2, the bin holder assembly 10 may be used in combination with standard wire shelving 46. The connections between the wire shelving 46 and the upstanding posts 12, 14 is the same as the connection between the collars 24 and the posts.

What is claimed is:

1. A double sided bin holder assembly comprising:

four upstanding posts, including two spaced apart front posts and two spaced apart rear posts, and at least one horizontal H-shaped frame comprising:

two spaced apart parallel side bars having opposite ends and extending front-to-back on the assembly, at least one middle bar connected between the side bars and configured to extend side-to-side on the assembly, having at least one upwardly extending flange that functions to receive and support a plurality of bins each with an undercut portion thereon that fits over the flange, and a collar at each end of the side bars constructed and arranged for adjustable connection to the upstanding posts.

2. A double sided bin holder assembly as in claim 1 in combination with a plurality of bins each having a rear wall with an outer undercut portion adjacent thereto, the at least one upwardly extending flange on the middle bar of the H-shaped frame being releasably received within the outer undercut portions on the bins with the rear walls resting against the flange.

3. The combination of claim 2 including a pair of spaced apart upwardly extending flanges on the middle bar of the H-shaped frame that function to receive and support a plurality of bins each with an undercut portion thereon.

4. The combination of claim 3 wherein the upwardly extending flanges are equally spaced apart from one another and include a front flange and a rear flange.

5. The combination of claim 4 wherein the front flange includes a lower portion that extends downwardly and slightly forward at an angle of about 5 degrees, and the rear flange includes a lower portion that extends downwardly and slightly rearward at an angle of about 5 degrees.

6. The double sided bin holder assembly of claim 1, further comprising wire shelving adjustably connected to the upstanding posts.

7. A double sided bin holder assembly comprising:

four upstanding posts including two spaced apart front posts and two spaced apart rear posts; and at least one horizontal H-shaped frame comprising:

two left collars and two right collars, wherein each left collar and each right collar are constructed and arranged for adjustable connection to the upstanding posts, a left side bar extending between the two left collars, a right side bar extending between the two right collars; wherein the left side bars and right side bars are horizontal and parallel, and at least one middle bar, extending between the side bars, including at least two upwardly extending flanges that function to receive and support a plurality of bins, wherein each bin has an undercut portion that fits over the upwardly extending flanges.

8. The double sided bin holder assembly of claim 7, further comprising a plurality of bins coupled to the at least one middle bar.

9. The double sided bin holder assembly of claim 8, wherein the at least one middle bar is coupled to an undercut portion on each bin.

10. The double sided bin holder assembly of claim 7, wherein the upwardly extending flanges are equally spaced apart from one another and include a front flange and a rear flange.

11. The double sided bin holder assembly of claim 10, wherein the front flange includes a lower portion that extends downwardly and slightly forward at an angle of about 5 degrees.

12. The double sided bin holder assembly of claim 10, wherein the rear flange includes a lower portion that extends downwardly and slightly rearward at an angle of about 5 degrees.

13. The double sided bin holder assembly of claim 10, wherein the front flange and the rear flange have lower portions that extend downwardly and slightly forward at an angle of about 5 degrees.

14. The double sided bin holder assembly of claim 7, further comprising wire shelving adjustably connected to the upstanding posts.

15. A double sided bin holder assembly comprising:

four upstanding posts, including two spaced apart front posts and two spaced apart rear posts, and at least one horizontal H-shaped frame comprising:

two spaced apart parallel side bars having opposite ends and extending front-to-back on the assembly, at least one middle bar connected between the side bars and configured to extend side-to-side on the assembly, having at least two upwardly extending flanges on the middle bar of the H-shaped frame that functions to receive and support a plurality of bins each with an undercut portion thereon that fits over the flange, wherein each flange includes a lower portion that extends downwardly and slightly forward at an angle of about 5 degrees, and a collar at each end of the side bars constructed and arranged for adjustable connection to the upstanding posts.

* * * * *